United States Patent [19]

Verble

[11] Patent Number: 4,777,775

[45] Date of Patent: Oct. 18, 1988

[54] APPARATUS FOR ATTACHING ROOFING MEMBRANE TO A STRUCTURE

[75] Inventor: Patrick R. Verble, Fortville, Ind.

[73] Assignee: North American Roofing Company, Inc., Carmel, Ind.

[21] Appl. No.: 20,561

[22] Filed: Mar. 2, 1987

Related U.S. Application Data

[63] Continuation-in-part of Ser. No. 865,765, May 22, 1986, Pat. No. 4,658,558.

[51] Int. Cl.[4] ..... E04D 5/14

[52] U.S. Cl. ..... 52/410; 52/698; 411/431

[58] Field of Search ..... 52/410, 63, 96, 506, 52/512, 698, 509, 713; 24/113, 459, 461; 160/399; 411/431, 368–377, 429, 508–510, 531, 533

[56] References Cited

U.S. PATENT DOCUMENTS

| | | | |
|---|---|---|---|
| 4,136,598 | 1/1979 | Hughes | 411/372 |
| 4,549,331 | 10/1985 | Coley | 24/113 R X |
| 4,617,771 | 10/1986 | Tomaszewski | 52/410 |
| 4,658,558 | 4/1987 | Verble | 52/410 |

FOREIGN PATENT DOCUMENTS

| | | | |
|---|---|---|---|
| 1609328 | 4/1970 | Fed. Rep. of Germany | 52/410 |

*Primary Examiner*—J. Karl Bell

*Attorney, Agent, or Firm*—Woodard, Emhardt, Naughton Moriarty & McNett

[57] ABSTRACT

A roof membrane anchoring system in accordance with the present invention includes an anchoring plate with a roof engaging surface and a top surface that can be attached to an existing structure. The anchoring plate has an axial opening therein into which a lop extends. An insert is inserted into the axial opening in the anchoring plate once a roofing membrane is inserted into the axial opening in the plate. The insert has a greatest diametrical dimension. The anchoring system is designed to assume a first state wherein the greatest diametrical dimension of the insert is slightly less than the inside diameter of the axial opening and slightly greater than the inside diameter of the lip extending into the axial opening and a second state wherein the greatest diametrical dimension of the insert is slightly less than the inside diameter of the lip which extends into the axial opening.

10 Claims, 7 Drawing Sheets

APPARATUS FOR ATTACHING ROOFING MEMBRANE TO A STRUCTURE

CROSS REFERENCE TO RELATED APPLICATION

This application is a continuation-in-part of my copending U.S. patent application, Ser. No. 865,765 filed May 22, 1986 now U.S. Pat. No. 4,658,558.

BACKGROUND OF THE INVENTION

This invention relates to an apparatus for attaching roofing membrane to a structure, and more particularly to an apparatus that does not require puncturing of the roofing membrane.

There are a wide variety of roofing systems used for various types of buildings. For larger buildings with generally flat roof surfaces or domed surfaces, flexible sheet material, for example, EPDM rubber membrane, is becoming increasingly popular due to its many well known advantages. This membrane-type roofing is attached to the structure by basically four different systems. The first system is an adhered system wherein the entire surface is coated with suitable cement and the membrane is then stretched across the surface with separate layers of membrane being overlapped and cemented to form a water-tight barrier. This system is very time consuming and expensive due to the cost of cement and the labor in applying the cement. In the partially adhered system bonding takes place at only special plate areas and at the overlap between the sheeting material. This system suffers from many of the same deficiencies as the adhered system. In a ballast system, membrane is laid on top of the roof and a layer of small stones is placed across the roof to hold the membrane to the roof. There are two separate types of mechanically fastened systems. One system incorporates battens which are arranged over the overlapping portions of the sheeting material and then secured to the roof with a layer of membrane being placed over the battens and adhered to the batten and the underlying membrane to form a water-tight barrier. A second type of mechanical fastening system incorporates anchors which are spaced across the roof and the membrane is then anchored at specific locations to the roof. Many of these anchoring systems require penetration of the roof membrane in the process of anchoring the membrane to the structure. Thus an additional sealing component must be added increasing the time and expense necessary for attaching the membrane to the roof. Some anchoring systems have been adapted to eliminate the need for penetrating the roofing membrane. However, these anchoring systems are either complicated and require hardware that must be manufactured at considerable expense or can be easily damaged when workers are required to walk across the roof.

Various methods and devices for attaching roofing membrane to a structure are disclosed by the following group of patent references. Each reference pertains in one way or another to attaching roofing membrane to a surface though some references are believed to be more relevant to the present invention than others. It is believed by the applicant that the following references are illustrative of the many anchoring systems currently available.

| U.S. Pat. No. | Patentee |
|---|---|
| 4,519,175 | Resan |
| 4,543,758 | Lane |
| 4,502,256 | Hahn |
| 4,520,606 | Francovitch |
| 4,455,804 | Francovitch |
| 1,609,328 | Fed. Rep. of Germany |
| 2,330,901 | France |

Resan discloses a lubricated roofing membrane fastener which does not require that the roofing membrane be penetrated in order to attach it to the structure. However, Resan does not disclose the precise invention claimed in this application and suffers from being easily tripped over or having the cover 35 kicked off when workers are required to cross the roof.

Lane discloses a rail and cap strip for securing rubber roof membrane to a deck without fastener penetrations. Lane appears to be a combination of a batten system and anchor system. The only relevancy to the present invention is that no penetration of the membrane is required.

Hahn discloses an arrangement for securing a flexible web to a walling means. The invention disclosed in Hahn does not require penetration of the flexible web and that is believed to be the extent of the relevancy to the present invention. Hahn requires a substantial portion of the anchoring means to remain above the web material allowing the anchor to be damaged or tripped over when workers are required to walk across the roof.

Francovitch '606 discloses a roof membrane and anchoring system using dual anchor plates. FIGS. 5–9 disclose anchoring mechanisms which do not require the penetration of the roofing membrane. Also Francovitch discloses a low profile anchoring systems which, to a certain extent, alleviates some of the problems inherent with other anchoring systems.

Francovitch '804 discloses a membrane anchor. The relevancy of '804 is believed to be limited to disclosure of a plate in FIGS. 1–5 which has the same general outward shape as the anchoring plate component of the present invention.

The German patent discloses a wide variety of methods and apparatus for anchoring sheet type roofing. FIG. 9 illustrates a three-part device which does not require penetration of the roofing membrane. However, it appears the device must be inserted in a bore drilled into the roofing surface and therefore would require substantial time in placing the device. Additionally, the device disclosed in FIG. 9 does not incorporate the use of compression cuts in order to ease the insertion of the cap within the anchor plate. Later complete translation of the German patent reveals that the device disclosed therein was intended for use in lining tunnel walls and not for roofing.

The French patent illustrates an anchoring mechanism which uses a cap that is inserted into a hole in the structure with the cap being compressible to be inserted into the hole and then expandable to remain secured within the hole. The French patent requires a large hole to be drilled or bored in the existing structure so that any failure of the anchoring mechanism would almost invariably lead to leaks in the roof of the structure.

From the foregoing it is clear that none of the references cited specifically solves all of the problems inherent in anchoring mechanisms for roofing systems. Additionally none of the cited references either incorporate or suggest the combination of all of the elements of the present invention.

SUMMARY OF THE INVENTION

One embodiment of the present invention is an apparatus for attaching roofing membrane to a structure which uses a disk-shaped anchoring plate with a flat bottom and a radiused top which is attached directly to the structure. There is an axial opening in the radiused top with a lip and a flange extending into the opening to form a channel within the opening. The membrane is then laid over the anchoring plate with a portion of the membrane inserted in the axial opening and then a cap is inserted in the opening to secure the membrane to the anchoring plate without causing penetration of the membrane. The cap has a disk-shaped top and a cylindrical body with V-shaped flanges at the bottom of the body. Compression cuts are made through the cylindrical body and the V-shaped flanges to allow the cylindrical body to be compressed from a first state, wherein the outside diameter of the cylindrical body is slightly less than the inside diameter of the lip in the axial opening of the anchoring plate, to a second state, wherein the greatest diametrical dimension of the cylindrical body and the V-shaped wedge is slightly less than the inside diameter of the lip in the axial opening in the anchoring plate. When the cap is inserted into the anchoring plate the cylindrical body again conforms to the first state. One variation of the present invention incorporates an cavity which extends through the cylindrical body and the disk to form a ring type cap which is inserted into the anchoring plate and then a plug having a diameter approximately equal to the diameter of the cylindrical opening is inserted into the ring cap thereby locking the cylindrical body in the first state.

A further embodiment of the present invention is an apparatus for attaching roofing membrane to a structure which uses an anchoring plate which is attached directly to the structure. There is an axial opening in the top of the anchoring plate with a lip extending into the axial opening. The membrane is then laid over the anchoring plate with a portion of the membrane inserted in the axial opening and then an insert is inserted in the opening to secure the membrane to the anchoring plate without causing penetration of the membrane. There may be at least one protrusion extending from the bottom surface of the anchoring plate which will penetrate insulation on the roof being covered to prevent the anchoring plate from rotating when it is attached to the roof by linear fasteners. The anchoring plate has fastening holes therethrough to allow affixation to the roof with linear fasteners. Anchor hole caps with downwardly extending protrusions designed to be snapped into diametrically opposed openings near the attachment holes are also provided to prevent the linear fasteners from backing out of the roof.

There are many possible variations of the insert, one of which is a cap that has a disk-shaped top and a cylindrical body with a circumferential protrusion at the bottom of the cylindrical body. Compression cuts are located in the apparatus to allow the apparatus to attain a first state and a second state. In the first state, the outside diameter of the cylindrical body is slightly less than the inside diameter of the lip in the axial opening of the anchoring plate. In the second state, the greatest diametrical dimension of the cylindrical body and the circumferential protrusion is slightly less than the inside diameter of the lip in the axial opening in the anchoring plate. When the cap is inserted into the anchoring plate, the apparatus conforms to the first state. One variation of the present invention incorporates a cavity which extends through the cylindrical body and the disk to form a ring type cap which is inserted into the anchoring plate and then a plug having a diameter approximately equal to the diameter of the cylindrical opening is inserted into the ring cap, thereby locking the cylindrical body in the first state.

Further embodiments of the invention include a base plate as described above and an insert capable of attaining two states. In the first state, the greatest radial dimension of the insert is slightly less than the inside diameter of the axial opening but slightly greater than the inside diameter of the lip in the axial opening. In the second state, the greatest radial dimension of the insert is slightly less than the inside diameter of the lip in the axial opening, thereby allowing insertion of the insert into the axial opening. After the roofing membrane is stretched across the roof and a portion of the membrane is inserted in the axial opening of the base plate, the insert, in the second state, is inserted in the axial opening and expanded to the first state in which it is locked to secure the roofing membrane to the structure. Among the various designs of the insert are: an O-ring and a plug that, when inserted in the O-ring, expands the O-ring to the first state and locks it therein; a disk of rubber or like material sandwiched between two inflexible disk-shaped plates so that wben the plates are compressed toward each other the rubber material expands from the second state to the first state; and a C-ring or snap-ring that is compressible from the first state to the second state by an appropriate force and which returns to the first state when the force is no longer applied.

One object of the present invention is to provide a low profile system for attaching roofing membranes to structures which does not allow for the attachment means to be easily damaged by workers walking on the roof.

A second object of the present invention is to provide a system for attaching roofing membrane to an existing structure which does not require penetration of the membrane.

A further object of the present invention is to provide a low cost and economical system for attaching roofing membrane to an existing structure.

Yet another object of the present invention is to provide a system for attaching roofing membrane to an existing structure which does not require extensive modification to the existing structure.

Related objects and advantages of the present invention will be apparent from the following description.

DESCRIPTION OF THE PREFERRED EMBODIMENT

Figure 1:
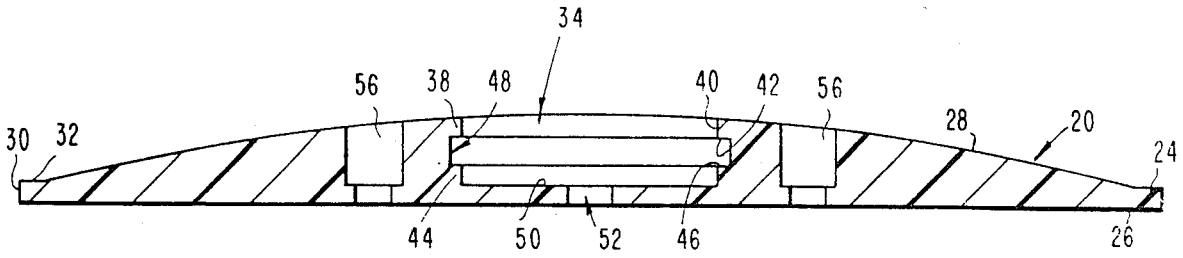
FIG. 1 is a cross-sectional view of an anchoring plate in accordance with the present invention.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Figure 2:
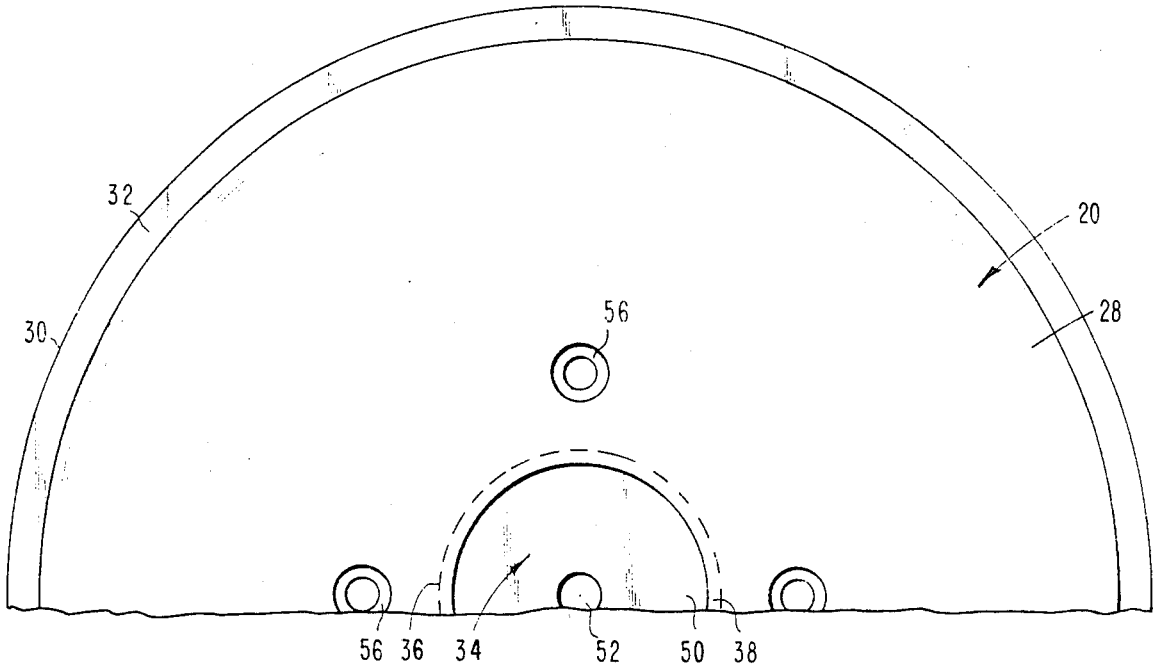
FIG. 2 is a partial top view of the anchoring plate of FIG. 1.

Referring to FIGS. 1, 2, 9 and 10, there is illustrated an anchoring plate 20 for attachment to a structure 22 (FIGS. 9 and 10) such as the roof of a large building. Anchoring plate 20 is a disk 24 with a substantially planar bottom surface 26 and a radiused top surface 28. As can be seen from the drawings, the top surface is convexly radiused so that there is a substantially thicker center portion with the anchoring plate 20 being thinner near the peripheral edge 30. Extending circumferentially around the peripheral edge is a thin planar ring 32 which extends between the peripheral edge 30 and peripheral edge of the radiused top surface 28. There is an axial opening 34 at the center of anchoring plate 20 which is cylindrical. For purposes of convenience in describing the invention, axial opening 34 is defined as that part of the opening at the center of disk 24 with the greatest inside diameter. If axial opening 34 extended through the top surface with no structure extending into the axial opening, it would appear from the top view to be illustrated as dotted line 36 in FIG. 2. However, axial opening 34 does not extend through the radiused top surface 28 as a lip 38 extends radially into axial opening 34 from the radiused top surface 28. Lip 38 extends into axial opening 34 around the entire circumference of axial opening 34 as is best illustrated in FIG. 2. Lip 38 has a cylindrical side surface 40 and a ring shaped bottom surface 42. Also extending radially into axial opening 34 is a bottom flange 44. Bottom flange 44 has a ring-shaped top surface 46. Therefore, it should be understood that bottom flange 44 extends radially into axial opening 34 around the entire circumference of axial opening 34. A channel 48 is defined by ring-shaped bottom surface 42 of lip 38, ring-shaped top surface 46 of bottom flange 44 and radial axial opening 34. Extending through the lower surface 50 of axial opening 34 there is an axial attachment hole 52 through which an appropriate linear fastener 54 (FIGS. 9 and 10) may be inserted to attach anchoring plate 20 to structure 22. It should be understood that the choice of linear fastener 54 will depend upon the type of structure to which the anchoring plate is to be attached. Among the typical types of linear fasteners 54 are nails, screws, and rivets, however, any appropriate linear fastener for the type of structure 22 may be incorporated. A plurality of alternate attachment holes 56 are also provided.

Figure 3:
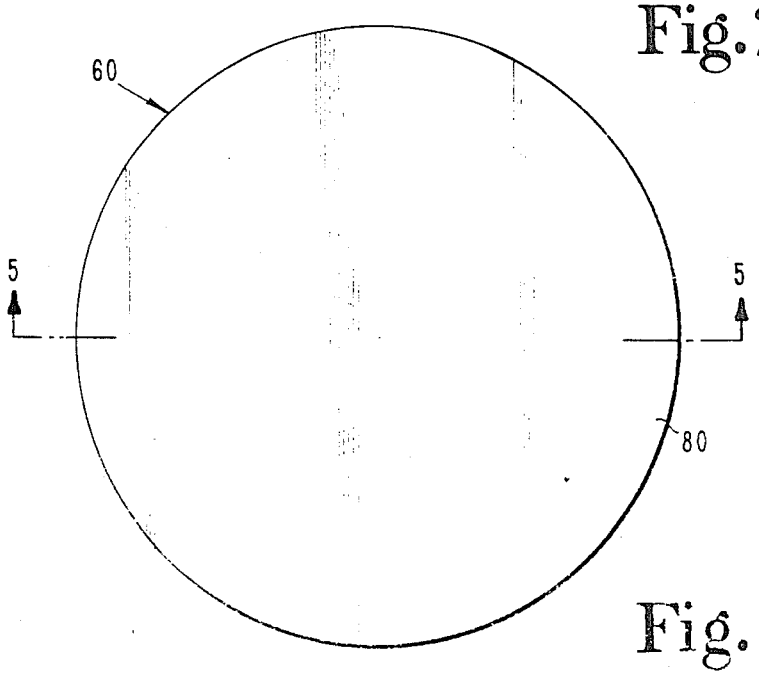
FIG. 3 is a top view of a first cap in accordance with the present invention.
Figure 4:
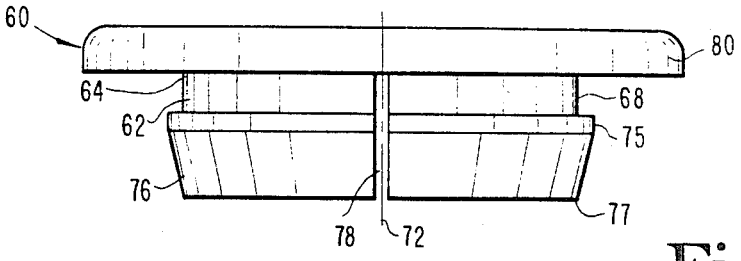
FIG. 4 is a side view of the cap of FIG. 3.
Figure 5:
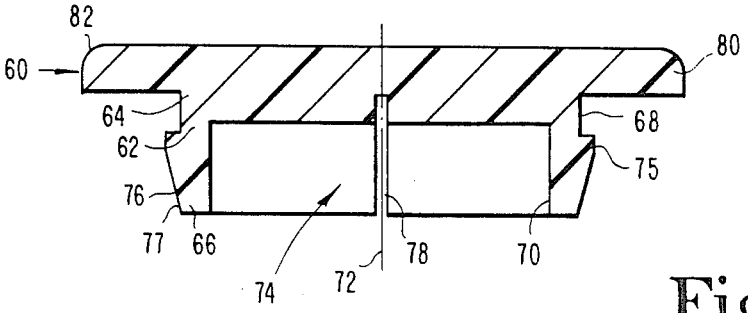
FIG. 5 is a cross-sectional view along lines 5—5 of FIG. 3.

Referring to FIGS. 3–10, there is illustrated a cap 60 which is inserted into anchoring plate 20 to secure the roofing membrane 58 (FIGS. 9 and 10) to anchoring plate 20. Referring more particularly to FIGS. 3–5, a cap 60 of a first embodiment is illustrated. Cap 60 consists of a resilient cylindrical body 62 having a top end 64 and bottom end 66. Cylindrical body 62 has an outer wall 68 and an inner wall 70. Cylindrical body 62 has a longitudinal axis 72 about which inner wall 70 defines a concentric downwardly opening cylindrical cavity 74. Attached to the bottom end 66 is a V-shaped flange 76 which extends radially beyond the outer wall 68 around the entire circumference of cylindrical body 62. V-shaped flange 76 tapers inwardly from its top 75 to its bottom 77. A plurality of compression cuts 78 extend through the cylindrical body and the V-shaped flange 76. Attached to the top end 64 of the cylindrical body 62 is a disk 80 which has an outside diameter 99 (FIG. 11) greater than the greatest diametrical dimension 97 of cylindrical body 62 and V-shaped flange 76. This disk 80 may be constructed with the radiused corners 82.

Figure 6:
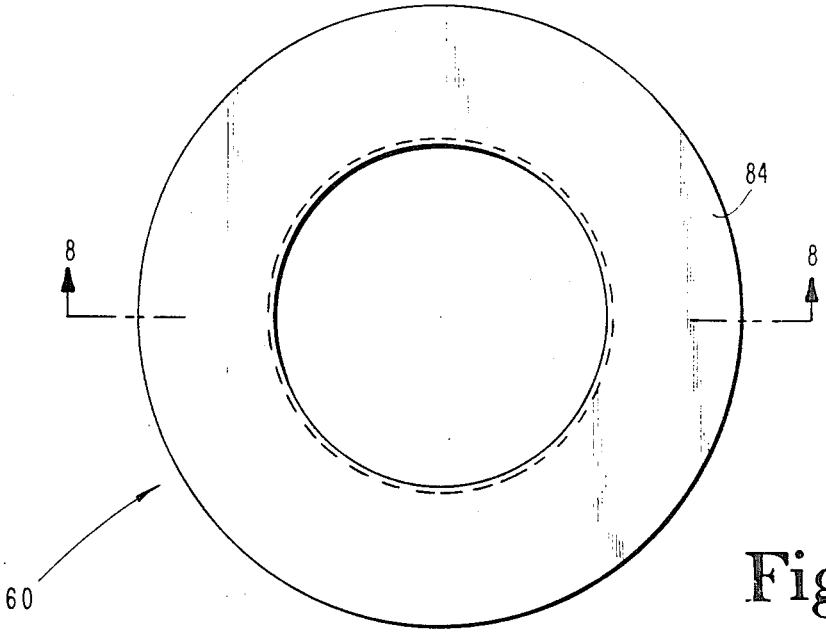
FIG. 6 is a top view of a second cap in accordance with the present invention.
Figure 7:
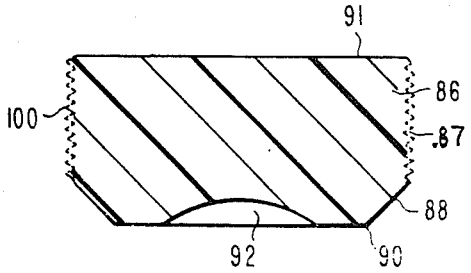
FIG. 7 is a cross-sectional view of a plug to be used with the cap of FIG. 6.
Figure 8:
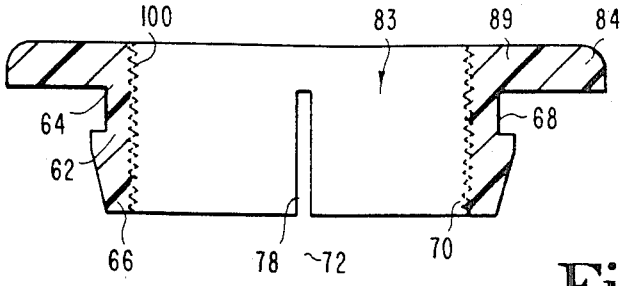
FIG. 8 is a cross-sectional view of the cap of FIG. 6.

Referring to FIGS. 6–8, there is illustrated a second embodiment of a cap 60 in accordance with the present invention. This cap also has a resilient cylindrical body 62 with a top end 64 and a bottom end 66 as well as an outer wall 68. an inner wall 70 and a longitudinal axis 72. However. this cap differs in that downwardly opening cylindrical cavity is also an upwardly opening cylindrical cavity 83 which is concentric about longitudinal axis 72. Since the cavity extends through what was the disk 80 in the first embodiment, in the second embodiment, there is a ring B4 attached to the top end 64 of the resilient cylindrical body 62. Additionally, there is a plug 86 sized to fit within the cylindrical cavity 83.

The plug 86 has a taper 88 near the bottom 90 of the side walls 87 to ease the insertion of the plug into the cylindrical cavity 83. Additionally, in the bottom 90, there is a recess 92 of sufficient size to accommodate the head of the linear fastener 54. The plug 86 is of a length sufficient to allow the top surface 91 to be flush with the top surface 89 of ring 84 when tbe plug is inserted into cap 60 as is best illustrated in FIG. 10.

Figure 9:
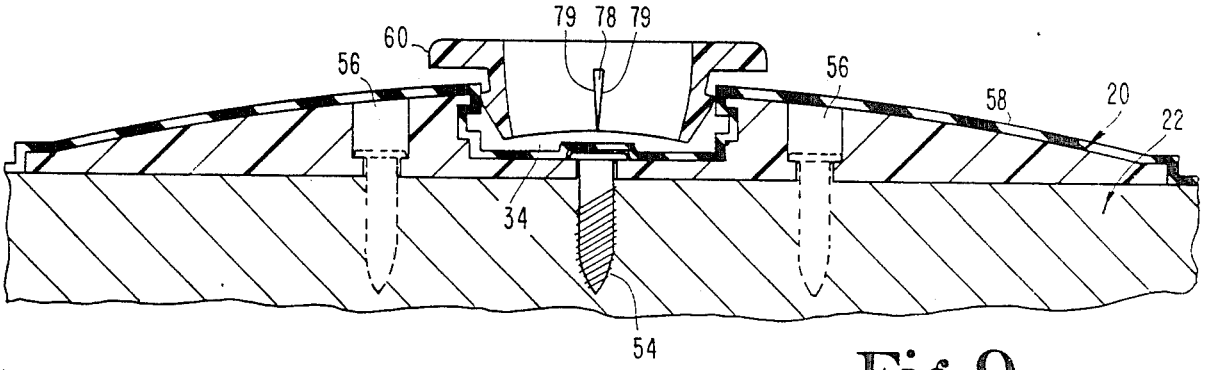
FIG. 9 is a cross-sectional view of the system described in the present invention during insertion of the cap into the anchoring plate.
Figure 10:
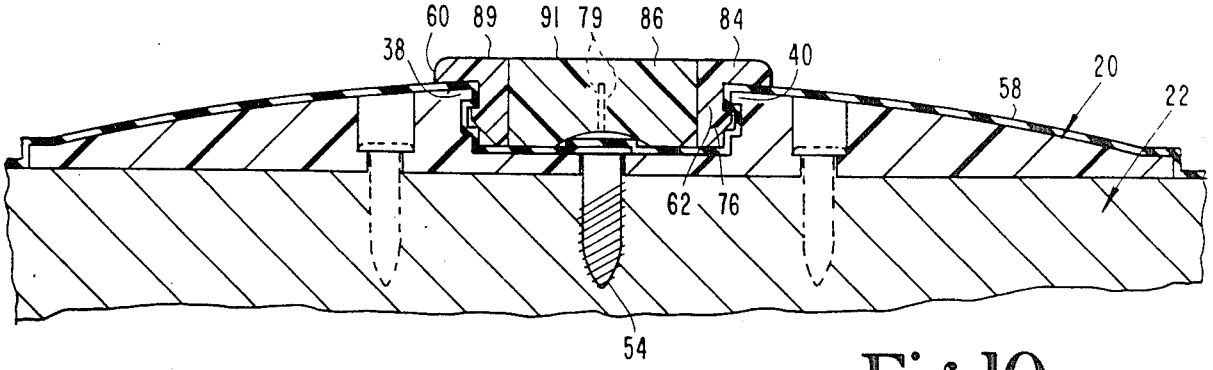
FIG. 10 is a cross-sectional view of one embodiment of the present invention when the roofing membrane is completely anchored to the structure.
Figure 11:
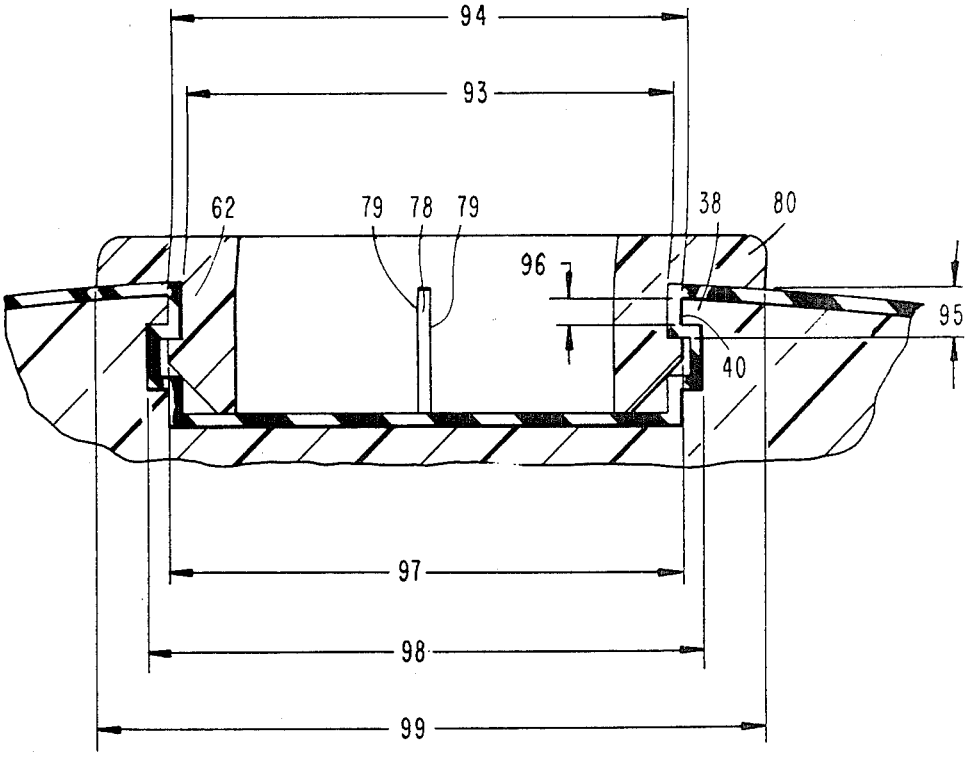
FIG. 11 is a blown-up view of a portion of FIG. 10.

The inter-relationship between the anchoring plate 20 and the cap 60 is best illustrated in FIGS. 9,10 and 11. As can be seen fro FIG. 11, the outside diameter 93 of cylindrical body 62 is slightly less than the inside diameter 94 of cylindrical side surface of lip 38. The distance 95 between the bottom of the disk 80 or ring 84 to the top of the V-shaped flange 76 is slightly greater than the thickness 96 of the lip 38. The greatest diametrical dimension 97 of the cylindrical body 62 and the V-shaped flange 76 is slightly less than the inside diameter 98 of axial opening 34. The outside diameter 99 of disk 80 or ring 84 is substantially greater than the inside diameter 94 of cylindrical side surface 40 of lip 38. These measurements are critical in order for the anchoring system to function properly. The utility of the compression cut 78 is best illustratedin FIGS. 9 and 10. Compression cut 78 is designed to allow the cylindrical body 62 of cap 60 to assume a first state illustrated in FIGS. 8, 4, 5, 10 nd 11 wherein the sides 79 of the cut are parallel to one another. Additionally, the cap 60 can assume a second state best illustrated in FIG. 9 wherein the sides 79 of the cylindrical compression cut 78 converge toward bottom end 66 of the resilient cylindrical body 62. In the second state, the greatest diametrical dimension 97 of cylindrical body 62 and V-shaped flange 76 is diminished to be slightly less than the inside diameter 94 of cylindrical side surface 40 of lip 38. This allows for the cap 60 to be inserted into anchoring plate 20 after membrane 58 has been extended across the anchoring plate 20 and inserted into axial opening 34. Once the cap 60 is completely inserted into axial opening 34, the cylindrical body 62 resumes its first state and the sides 79 of the compression cut 78 are once again parallel (as illustrated by the dotted lines in FIG. 10) and the top of V-shaped flange 76 is received in channel 48. At this time, if the second embodiment of cap 60 is used, plug 86 may be inserted into cylindrical cavity 83 and thereby lock cylindrical body 62 into the first state so that the cap 60 cannot be inadvertently knocked out of the anchoring plate 20. Plug 86 and cylindrical cavity 83 may be designed so that plug 86 is driven into cylindrical cavity 83 or so that either or both plug 86 and cylindrical cavity 83 will have threads 100 which will allow the plug 86 to be screwed into cylindrical cavity 83.

These threads 100 are illustrated by the dotted lines in FIGS. 7 and 8, while a smooth sided plug 86 and cylindrical cavity 83 are illustrated in the remainder of the drawings illustrating the second embodiment of cap 60. As can be seen from FIGS. 9 and 10, the use of compression cut 78 and of the particular design of both the anchoring plate 20 and caps 60 allows the membrane 58 to be secured to the anchoring plate 20 which is secured to the structure 22 without membrane 58 being penetrated in any way so that the water-tight integrity of membrane 58 is maintained.

FIG. 10 best illustrates that the anchoring system of the present invention is very low profile and therefore cannot be easily damaged by workers walking on the roof after or during installation. Anchor plate 20, because of radiused top surface 28, results in only slight and gradual deviation of the roof surface. Cap 60 does not protrude greatly beyond the roof membrane as only the thin ring 84 or disk 80 of cap 60 is not received within axial opening 34. Because so little of cap 60 protrudes above roofing membrane 58, there is very little chance that a blow sufficient to dislodge cap 60 could be administered by the foot of a worker walking on the roof.

It is envisioned that cap 60 and anchoring plate 20 may be manufactured or molded from a wide variety of materials. One material which is envisioned is a hard plastic because it is sufficiently flexible to be compressed, through the use of compression cuts 78, into the second state, yet rigid enough that once cap 60 and anchoring plate 20 are snapped together there will be secure attachment of roofing membrane 58 to structure 22.

Figure 12:
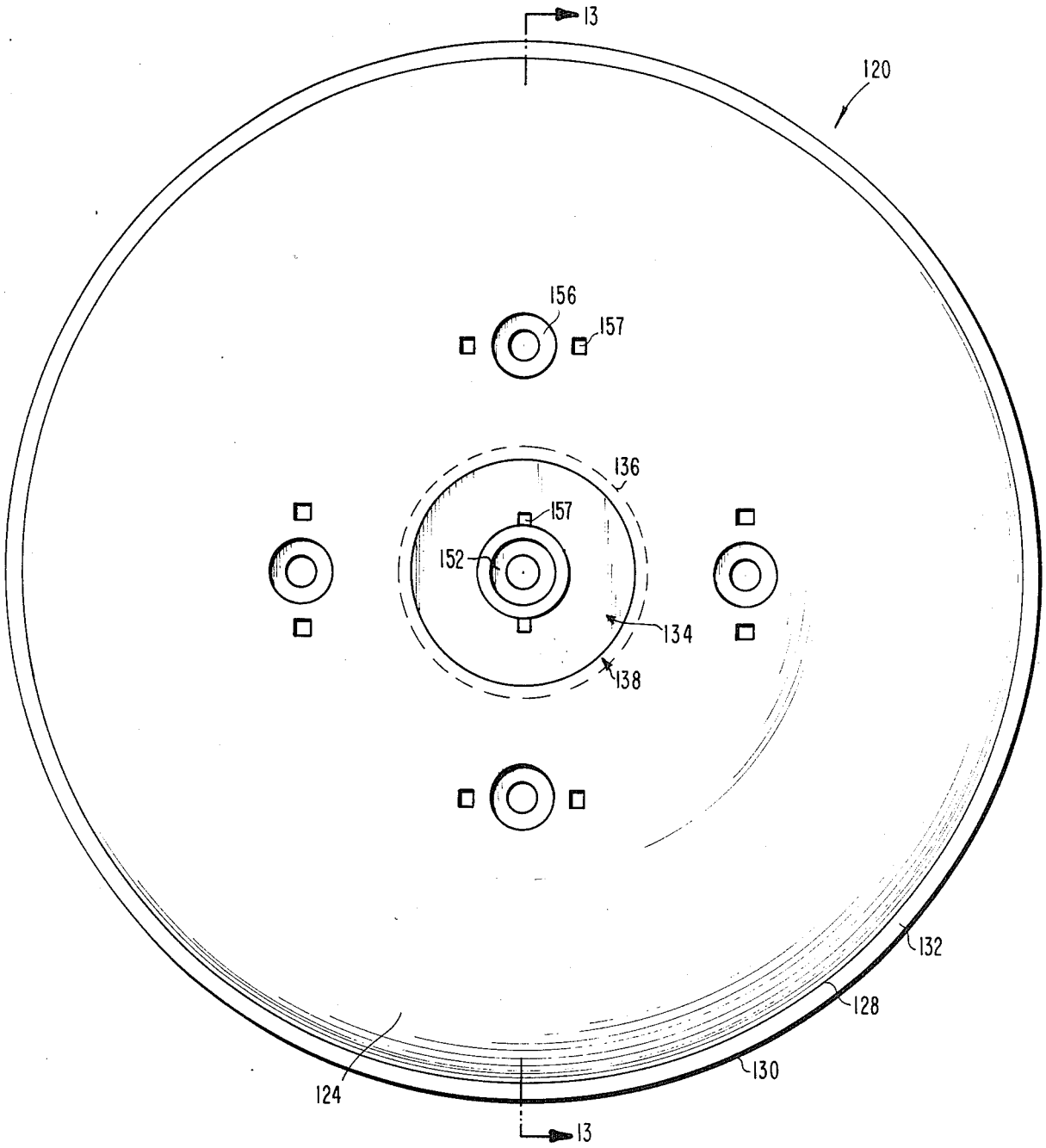
FIG. 12 is a top view of an additional embodiment of an anchoring plate in accordance with the present invention.
Figure 13:
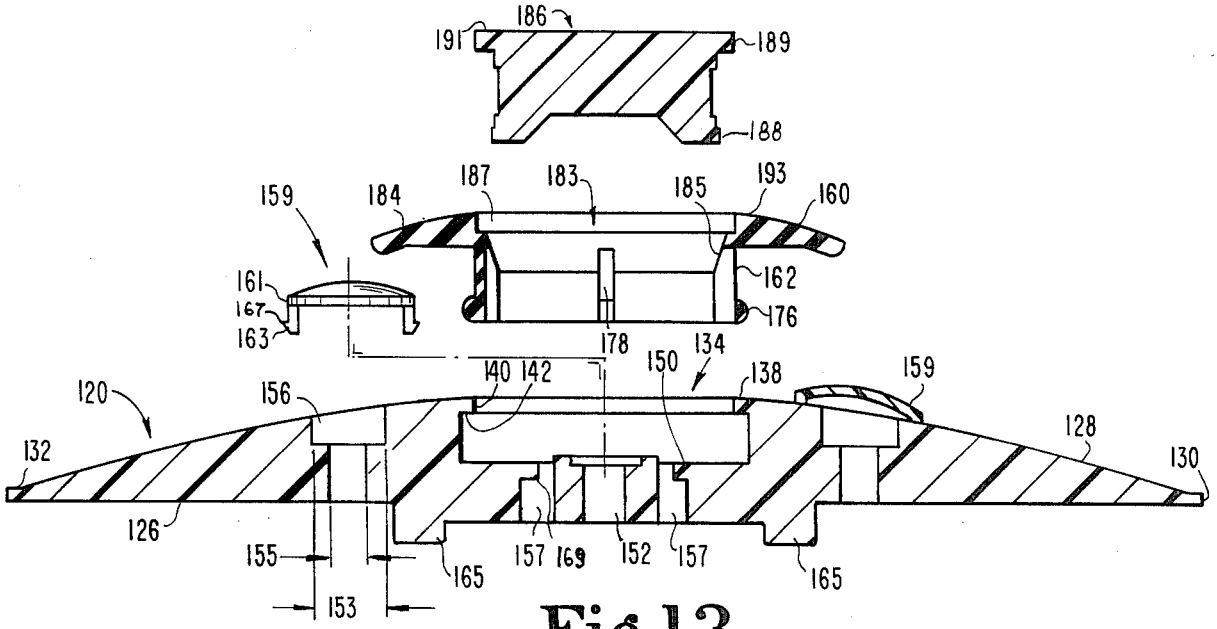
FIG. 13 is a cross-sectional view along line 113—113 of FIG. 12 and also includes a cross-sectional view of an additional cap and plug arrangement.
Figure 14:
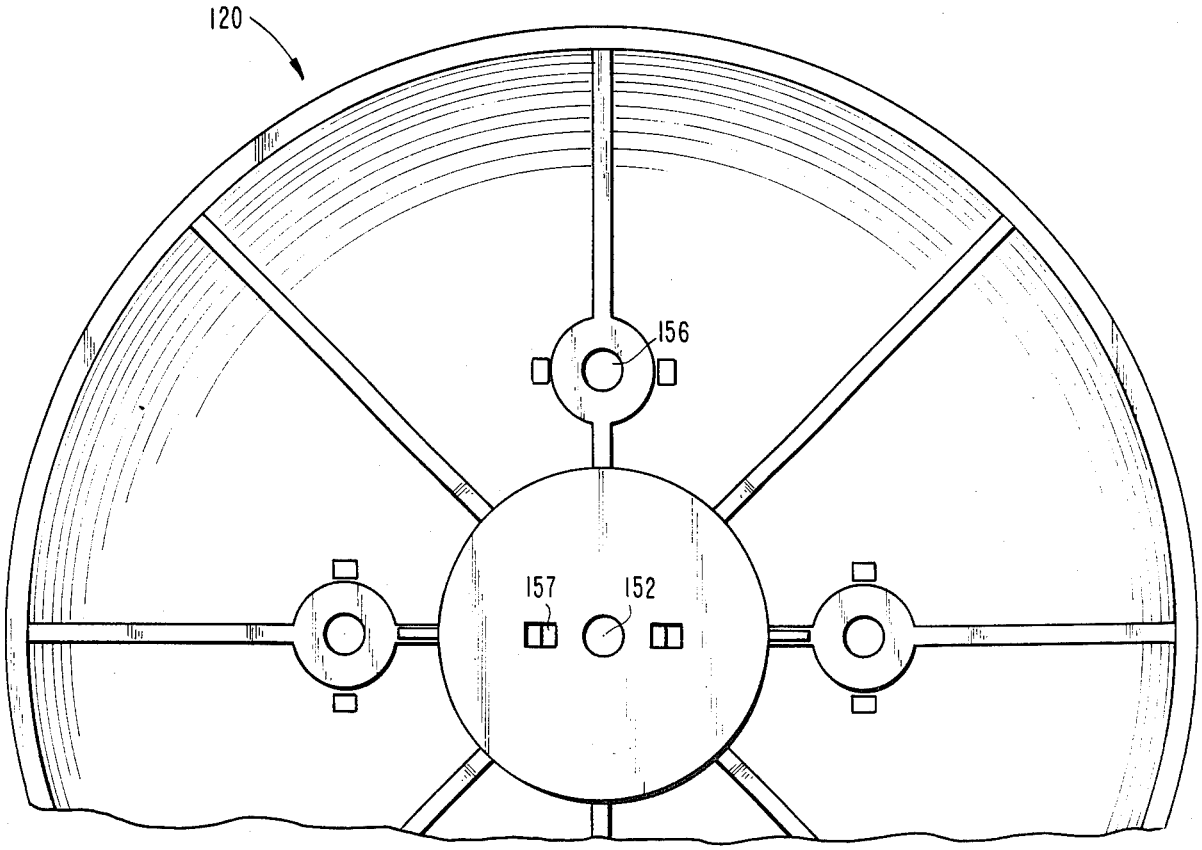
FIG. 14 is a partial bottom view of the anchoring plate of FIG. 12.

Referring to FIGS. 12, 13, and 14, there are illustrated various views of an additional embodiment of an anchoring plate 120 for attachment to a structure such as structure 22 (FIGS. 9 and 10) such as the roof of a large building. Anchoring plate 120 is a disk 124 with a bottom surface 126 which is hollowed out, as in FIG. 14, and a top surface 128 which is radiused. As can be seen from the drawings, when the top surface is convexly radiused there is a substantially thicker center portion with the anchoring plate 120 being thinner near the peripheral edge 130. Extending circumferentially around the peripheral edge is a thin planar ring 132 extending between the peripheral edge 130 and peripheral edge of the radiused top surface 128. There is an axial cylindrical opening 134 at the center of anchoring plate 120. For purposes of convenience in describing the invention axial opening 134 is defined as that part of the opening at the center of disk 124 with the greatest inside diameter. If axial opening 134 extended through the top surface with no structure extending into the axial opening, it would appear from the top view to be illustrated as dotted line 136 in FIG. 12; however, axial opening 134 does not extend through the top surface 128 as a lip 138 extends radially into axial opening 134 from the radiused top surface 128. Lip 138 extends into axial opening 134 around the entire circumference of axial opening 134 as is best illustrated in FIG. 12. Lip 138 has a cylindrical side surface 140 and a ring-shaped bottom surface 142. Extending through the lower surface 150 of axial opening 134, there is an axial attachment hole 152 through which an appropriate linear fastener such as fastener 54 (FIGS. 9 and 10) may be inserted to attaoh anohoring plate 120 to structure 22. A plurality of alternate attachment holes 156 are also provided.

Testing of the anchoring plate 20 illustrated in FIGS. 1–3 and 9–10 has revealed that in extreme conditions the linear fastener 54 may back out of the structure slightly, thereby allowing the anchoring plate 20 to rotate about linear fastener 54 if secured only through attachment hole 52. Two problems may arise from such a situation. First, if the anchoring plate 20 rotates, additional stresses are put on the sheeting material 58 received in opening 34. These stresses may cause sheeting material 58 to tear, destroying the wagertight integrity of a roof attached to a structure with this system. Second, if the linear fastener backs out of the structure sufficiently, the head of the linear fastener may penetrate the roofing membrane.

Anchoring plate 120 was designed to prevent the rotation encountered with anchoring plate 20 by incorporating a pair of protrusions 165 into the underside of the anchoring plate 120 as in FIG. 13. These protrusions engage the structure 22 and penetrate into any insulation covering the structure to prevent rotation of the anchoring plate.

As is illustrated in FIGS. 12 & 13, attachment hole 152 and alternate attachment holes 156 may have an inside diameter 153 in that portion of the attachment hole closest to the top surface large enough to accommodate the head of a linear fastener and an inside diameter 155 closer to the bottom surface of the anchoring plate smaller than the head of a linear fastener. A pair of diametrically opposed openings 157 are cut through the lower surface of the axial opening 134 in close proximity to the attachment hole 152. An anchor hole cap 159 with a disk-shaped body 161 (having a diameter exceeding the greater inside diameter of the attachment hole 152 or alternate attachment holes 156) and a pair of diametrically opposed downwardly extending tabs 163 (sized to be received in opening 157) may be inserted into the anchoring plate to reduce the possibility that the linear fastener 154 will back out of the structure and penetrate a roofing membrane 58 (FIGS. 9 and 10) positioned over the anchoring plate. The openings 157 are designed to provide a lip 167 against which V-shaped flanges 169 on the bottom of tabs lock themselves when the anchor hole cap 159 is snapped over the attachment hole 152. Alternate attachment holes 156 are also provided with openings 157 so that the plastic anchor hole cap 159 can be snapped over them as illustrated in FIG. 13.

Figure 15:
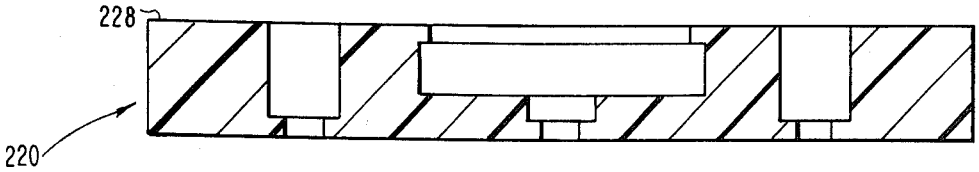
FIG. 15 is a cross-sectional view of a separate embodiment of an anchoring plate in accordance with the present invention.

FIG. 15 illustrates yet a third embodiment of an anchoring plate 220. Anchoring plate 220 is the same as anchoring plate 20 with the exception of the top surface 228 which is flat rather than radiused and with the further exception that anchoring plate 220 does not have a flange extending into the axial opening forming a channel.

FIG. 13 illustrates an additional embodiment of a cap 160 similar to the second embodiment of cap 60 described in the parent application. This embodiment is made of flexible rubber instead of resilient plastic. Cap 160 differs from the previously described embodiments in that the compression cuts 178 do not extend through protrusions 176. The compression cuts 178 may either extend substantially through the cylindrical body 162 as illustrated on the left side of the cap in FIG. 13 or completely through the cylindrical body 162 as illustrated on the right side of FIG. 13. Also, protrusions 176 are rounded rather than v-shaped as in the previous cap. These differences reduce the likelihood of accidental puncture and make cap 160 the preferred embodiment of the insert. Further, ring 184 extends beyond the outside diameter of the cylindrical body of the cap than was the case in the previously described embodiments. Additionally, there is an internal taper 185 near the top of the upwardly opening cylindrical cavity 183 and a lip 187 for receipt of a flange 189 on plug 186 that was not in the previous embodiment. Plug 186 does not have a taper near the bottom of the side walls to ease the insertion of the plug into the cylindrical cavity since this function is served by taper 185. In fact rather than a taper at the bottom, plug 186 has protrusions 188 at the bottom to increase the forces on the cap 160 which lock the cap into the axial opening. Plug 186 is of a length sufficient to allow the top surface 191 to be flush with the top surface 193 of ring 184 when the plug is inserted into cap 160.

Figure 16:
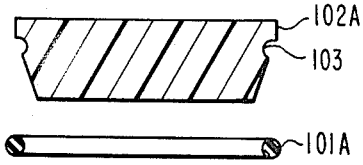
FIG. 16 is a cross-sectional view of one embodiment of an insert in accordance with the present invention.
Figure 17:
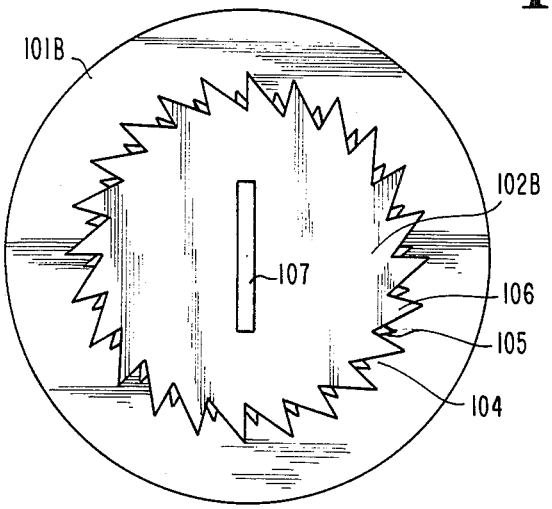
FIG. 17 is a top view of an embodiment of an insert in accordance with the present invention.

FIGS. 16–20 illustrate alternative embodiments of an insert to be placed within the anchoring plates 20, 120 and 220 as previously described. Each of these embodiments provides for locking a roofing membrane within the anchoring plate through various methods. FIGS. 16 and 17 illustrate the use of a rubber O-ring 101A & B which is inserted into the axial opening in the anchoring plate after a roofing membrane is inserted in the opening. Upon insertion of rubber O-ring 101, the O-ring is then expanded and locked in a position where it engages lip 38 or 138 and thereby secures the membrane within the anchoring plate. Expansion of the O-ring is caused by a plug 102A or plug 102B of appropriate design. With O-ring 101A having its interior surface smooth, a tapered plug 102A is inserted into the O-ring to expand the O-ring. Plug 102A may have notches 103 for seating of the O-ring 101A therein thereby locking the O-ring in an expanded state.

O-ring 101B has double ratchet teeth 104 and 105 formed on the inside surface. Plug 102B has ratchet teeth 106 on its outside diameter. Plug 102B is inserted in O-ring 101B and is rotated slightly until tooth 106 on the plug rides up tooth 104 on the O-ring and drops within the notch separating tooth 104 from tooth 105. This slight rotation of the plug expands the O-ring and increases the outside diameter of the O-ring allowing it to be locked within the axial opening in the anchoring plate. Slot 107 is placed in the plug to allow the plug to be rotated by a straight blade screwdriver. A square, hex or Phillips hole may be incorporated instead of slot 107. A configuration of the inside of O-ring 101B and the outside configuration of plug 102B may be of various design to provide for the expansion of O-ring 101B.

Figure 18:
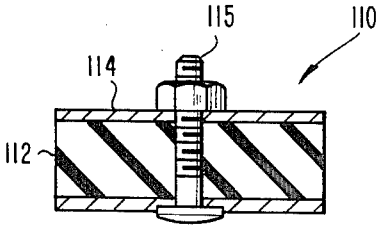
FIG. 18 is a cross-sectional view of an insert in accordance with the present invention.
Figure 19:
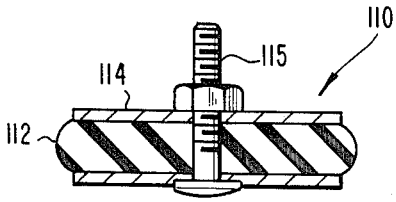
FIG. 19 is a cross-sectional view of the FIG. 18 insert with the insert in a first state.

FIG. 18 illustrates a compression plug 110 insertable in the axial opening of the anchoring plate. Compression plug 110 consists of a block or disk 112 of rubber or synthetic material sandwiched between two plates 114 constructed of rigid material, such as steel. Plates 114 are arranged relative to one another so that a compression means 115, such as a nut and bolt, connect the two plates 114. As compression means 115 is used to bring plates 114 closer together, the block or disk 112 of synthetic material is deformed so that the outside dimension of plug 110 is increased. This increase in outside dimension causes the plug 110 to be locked in the axial opening of the anchoring plate, thereby securing the roofing membrane to the anchoring plate. Plug 110 is shown in a compressed state in FIG. 19.

Figure 20:
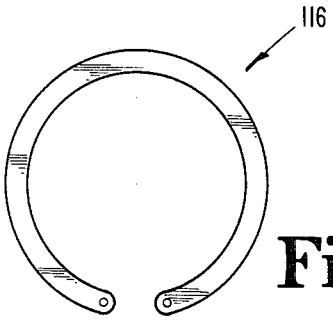
FIG. 20 is a top view of an insert in accordance with the present invention.

FIG. 20 illustrates yet another insert for use in securing a roofing membrane to the anchoring plate. A C-ring or snap-ring 116 made of spring metal or like material may be compressed from the first state to a second state and inserted in axial opening in the anchoring plate. When the compression force on the C-ring or snap-ring 116 is released, the C-ring or snap-ring returns to the first state and thereby locks the membrane in the axial opening of the anchoring plate.

The interrelationship between the anchoring plates 20, 120, and 220 and the various inserts is basically the same as was described in the parent application.

While the invention has been illustrated and described in detail in the drawings and foregoing description, the same is to be considered as illustrative and not restrictive in character, it being understood that only the preferred embodiments have been shown and described and that all changes and modifications that come within the spirit of the invention are desired to be protected.

What is claimed is:

1. A roof membrane anchoring system for securing a roof membrane to a structure, comprising:

an anchoring plate attachable to the structure, said anchoring plate comprising:

a roof engaging surface and a top surface, said top surface having an axial opening therein, said axial opening having a lower surface and a first inside diameter;

a lip extending into said axial opening near said top surface, said lip defining a second inside diameter less than said first inside diameter;

attachment means for attaching said anchoring plate to the structure;

an insert for securing the roof membrane to said anchoring plate by placing the roof membrane in said axial opening and locking said insert in said axial opening, said insert having a greatest diametrical dimension;

state altering means for altering the anchoring system between a first state wherein said greatest diametrical dimension is slightly greater than said second inside diameter and slightly less than said first inside diameter and a second state wherein said greatest diametrical dimension is slightly less than said second inside diameter, said state altering means including compression cuts in said anchoring system;

wherein said attachment means includes an attachment hole extending through said anchoring plate from said top surface to said roof engaging surface and further includes a linear fastener of appropriate design for the structure to which the anchoring plate is to be attached and wherein said attachment hole has a third inside diameter in that portion of the attachment hole which is closer to said top surface, said third inside diameter being of sufficient size to accommodate a head portion of said linear fastener, and wherein said attachment hole has a fourth inside diameter in that portion of the attachment hole which is closer to the roof engaging surface of said anchoring plate, said fourth inside diameter being smaller than the head of said linear fastener; and, an anchor hole cap and a snapping means for snapping said anchor hole cap over said attachment hole.

2. The invention of claim 1 wherein said insert comprises:

a body having a top end, a bottom end, an outer wall and an inner wall, said inner wall defining a downwardly opening cavity, said outer wall having a first outside diameter;

a protrusion attached to the bottom end of said body and extending beyond said outer wall, said protrusion and said body having a greatest diametrical dimension; and, wherein said compression cut extends through the body of said insert so that said insert is capable of attaining said first state and said second state without any change of configuration in said anchoring plate.

3. The invention of claim 2 wherein said state altering means further comprises a plurality of compression cuts in the body of said insert.

4. The invention of claim 2 wherein said insert assumes said first state when said insert is not subject to any compression forces and assumes said second state when said insert is subject to compression forces of inserting the insert into the anchoring plate and wherein said insert resumes said first state when received in the anchoring plate.

5. The invention of claim 2 wherein said downwardly opening cavity is also an upwardly opening cavity and said insert further comprises a plug sized to securely fit within said cavity.

6. The invention of claim 5 wherein said plug is threadingly engagable within said cavity.

7. The invention of claim 5 wherein said insert is lockable in said first state when said plug is received in said cylindrical cavity.

8. A roof membrane anchoring system for securing a roof membrane to a structure, comprising:

an anchoring plate attachable to the structure, said anchoring plate comprising:

a roof engaging surface and a top surface, said top surface having an axial opening therein, said axial opening having a lower surface and a first inside diameter;

a lip extending into said axial opening near said top surface, said lip defining a second inside diameter less than said first inside diameter;

attachment means for attaching said anchoring plate to the structure;

an insert for securing the roof membrane to said anchoring plate by placing the roof membrane in said axial opening and locking said insert in said axial opening, said insert having a greatest diametrical dimension;

state altering means for altering the anchoring system between a first state wherein said greatest diametrical dimension is slightly greater than said second inside diameter and slightly less than said first inside diameter and a second state wherein said greatest diametrical dimension is slightly less than said second inside diameter, said state altering means including compression cuts in said anchoring system; and, a pair of diametrically opposed penetrating protrusions extending radially and downwardly beyond said roof engaging surface of said anchoring plate, said penetrating protrusion designed and arranged to prevent rotation of said anchoring plate when said anchoring plate is attached to the structure.

9. A roof membrane anchoring system for securing a roof membrane to a structure, comprising:

an anchoring plate attachable to the structure, said anchoring plate comprising:

a roof engaging bottom surface; and, a top surface, said top surface having an opening therein for the receipt of a roofing membrane;

an insert designed and arranged to be received into the opening in said anchoring plate without penetrating a membrane which has been received in the opening;

locking means for locking said insert within said opening in said anchoring plate;

attachment means for attaching said anchoring plate to the structure; and, wherein said insert comprises:

a pair of rigid plates having dimensions slightly less than the inside dimension of said opening;

deformable material sandwiched between said plates, said deformable material having initial dimensions slightly less than the inside dimension of said opening; and, wherein said locking means comprises a means of compressing said deformable material between said pair of rigid plates so that the initial dimensions of said deformable material are sufficiently altered to lock said insert within said opening.

10. The invention of claim 9 wherein said deformable material is rubber.

* * * * *

UNITED STATES PATENT AND TRADEMARK OFFICE

CERTIFICATE OF CORRECTION

PATENT NO. : 4,777,775

DATED : October 18, 1988

INVENTOR(S) : Patrick R. Verble

It is certified that error appears in the above-identified patent and that said Letters Patent is hereby corrected as shown below:

In block 57 of the title page, line 5, please change "lop" to --lip--.

In column 4, lines 12 and 13, please change "attalning" to --attaining--.

In column 4, line 30, please change "when" to --when--.

In column 6, line 11, please insert a comma after "34".

In column 6, line 46, please change the period to a comma.

In column 6, line 47, please change the second period to a comma.

In column 6, line 52, please change "B4" to --84--.

In column 6, line 65, please change "fro" to --from--.

In column 7, line 10, please insert a space between "illustrated" and "in".

In column 7, line 12, please change "nd" to --and--.

In column 8, line 20, please insert a comma after "invention".

In column 8, line 36, please change "attaoh" to --attach--.

In column 8, line 36, please change "anohoring" to --anchoring--.

In column 8, line 48, please change "wagertight" to --watertight--.

UNITED STATES PATENT AND TRADEMARK OFFICE

CERTIFICATE OF CORRECTION

PATENT NO. : 4,777,775

DATED : October 18, 1988

INVENTOR(S) : Patrick R. Verble

It is certified that error appears in the above-identified patent and that said Letters Patent is hereby corrected as shown below:

In column 9, line 32, please change "througb" to --through--.
In column 10, line 3, please insert a comma after "therein".

Signed and Sealed this

Seventh Day of March, 1989

*Attest:*

DONALD J. QUIGG

*Attesting Officer*

*Commissioner of Patents and Trademarks*